United States Patent [19]

Tjerlund

[11] Patent Number: 4,802,219

[45] Date of Patent: Jan. 31, 1989

[54] METHOD AND APPARATUS FOR DISTORTING A SPEECH SIGNAL

[75] Inventor: Per Tjerlund, Upplands Väsby, Sweden

[73] Assignee: Telefonaktiebolaget L M Ericsson, Stockholm, Sweden

[21] Appl. No.: 573,937

[22] PCT Filed: Jun. 6, 1983

[86] PCT No.: PCT/SE83/00230

§ 371 Date: Jan. 13, 1984

§ 102(e) Date: Jan. 13, 1984

[87] PCT Pub. No.: WO83/04460

PCT Pub. Date: Dec. 22, 1983

[30] Foreign Application Priority Data

Jun. 11, 1982 [SE] Sweden ..... 8203648

[51] Int. Cl.[4] ..... H04K 1/04; H04K 1/08

[52] U.S. Cl. ..... 380/39; 380/38

[58] Field of Search ..... 179/1.5 S, 1.5 FS; 380/38, 28, 33, 39

[56] References Cited

U.S. PATENT DOCUMENTS

| | | | |
|---|---|---|---|
| 3,777,064 | 12/1973 | Allen et al. | 179/1.5 FS |
| 3,886,313 | 5/1975 | Branscombe et al. | 380/38 |
| 4,068,094 | 1/1978 | Schmid et al. | 380/39 |
| 4,188,506 | 2/1980 | Schmid et al. | 380/39 |
| 4,195,202 | 3/1980 | McCalmont | 380/39 |
| 4,221,931 | 9/1980 | Seiler | 179/1.5 R |
| 4,278,840 | 7/1981 | Morgan et al. | 179/1.5 S |
| 4,434,323 | 2/1984 | Levine et al. | 179/1.5 S |
| 4,525,844 | 6/1985 | Schenermann | 179/1.5 S |
| 4,551,580 | 11/1985 | Cox et al. | 179/1.5 S |
| 4,652,699 | 3/1987 | Akaiwe | 380/39 |
| 4,659,875 | 4/1987 | Taurin et al. | 380/38 |

OTHER PUBLICATIONS

"Analog Voice Privacy with a Microprocessor" by Sergei Udalov; May 14–16, 1980 pp. 27–37.

*Primary Examiner*—Salvatore Cangialosi

*Attorney, Agent, or Firm*—Roberts, Spiecens & Cohen

[57] ABSTRACT

Method of distorting a speech signal by rearranging and/or reversing frequency bands in this signal. The speech signal is divided into a plurality of sub-bands by filtering, and the sub-bands are individually sampled at a sampling frequencing which is at least double that of the sub-band bandwidth, for providing a plurality of first spectra each with periodic repetition of the respective sub-band. Alternating samples are polarity-reversed for providing a plurality of second spectra each with periodic repetition of the respective sub-band in reversed form. From one of these two types of spectrum a desired sub-band is then filtered out, and corresponds to the original sub-band, but is reversed and/or displaced in the frequency band as desired. All the obtained sub-bands are finally added to send the distorted signal.

As an addition to the method of distorting, there is also proposed a method of recomposing the distorted speech signal. Furthermore there is presented an apparatus for distorting or recomposing the speech signal in accordance with the methods.

3 Claims, 2 Drawing Sheets

METHOD AND APPARATUS FOR DISTORTING A SPEECH SIGNAL

TECHNICAL FIELD

The invention relates to a method of distorting a speech signal by rearranging frequency bands so that the speech becomes incomprehensible, the invention also relating to an apparatus for carrying out the method.

BACKGROUND ART

Different methods are known for making unwarrented listening-in difficult in wireless telecommunication. One method involves so-called time scrambling, where a time interval of the signal is divided into blocks of a given length, which are then rearranged and transmitted. The character of human speech and the desire to obtain low apprehensibility in the distorted signal results in that the blocks cannot be made too short. Longer blocks would, on the other hand, result in troublesome delay. Trials have shown that the delay which is introduced by a scrambler with tolerably low apprehensibility of the distorted signal is just over one second, which is very irritating in duplex connections.

Another known method of distorting speech is frequency scrambling, where the signal frequencies are first divided into a number of bands. The bands are then rearranged, with some of them being reversed, to provide an unintelligible signal.

Frequency scrambling is a simple method in principle, but it necessitates expensive and voluminous filter equipment to transpose up a frequency band by modulation, carry out a band limitation and finally a down transposition.

DISCLOSURE OF INVENTION

An object of the invention is to provide a method which, using less expensive means than those already known, e.g. integrated technique, affects the comprehensibility so that a suitable degree of secrecy is obtained.

The basic idea behind the invention is that the periodic repetition of the signal frequency spectrum in sampling, which is known in the art and described, inter alia, in chapter 3 of the publication Digital Signal Processing, Uppenheim & Schafer, Prentice Hall, is utilized for both displacing and reversing the respective frequency bands.

The invention is characterized by the disclosures in the claims.

BRIEF DESCRIPTION OF DRAWINGS

The invention is described in detail below with the aid of an embodiment and with reference to the accompanying drawings, on which

BEST MODE FOR CARRYING OUT THE INVENTION

Figure 1A:
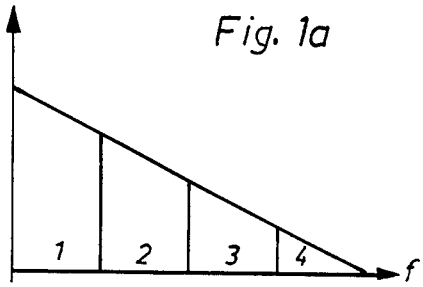
FIG. 1 illustrates the principle of the known frequency scrambling method, FIGS. 2*a*, 2*b* explain parts of the theoretical ground on which the invention stands.
Figure 1B:
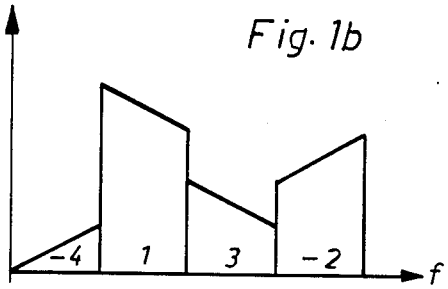

FIG. 1*a* illustrates the frequency spectrum of a speech signal. Satisfactory scrambling is obtained if the band width is divided into four sub-bands, for example, and selected sub-bands are moved to the frequency position of other sub-bands and/or are reversed. As will be seen from FIG. 1*a*, the sub-band 1 has been moved to the position of the sub-band 2, the sub-band 2 has been reversed and moved to the position of the sub-band 4, sub-band 3 has only been reversed and sub-band 4 has been reversed and moved to the position of sub-band 1. The disadvantage with this method is that it necessitates modulation of a band, e.g. a 4000 Hz band, by a frequency $f_1$, which is substantially higher than the cut off frequency of the band, in order to transpose the band up, as well as filtering out the desired sub-band, e.g. of a width of 1000 Hz, and finally modulation with a frequency $f_2$ to transpose down the filtered-out sub-band to the intended position. These steps necessitate expensive and voluminous filter equipment, and an object of the invention is to achieve the same purpose provided by the apparatus in the art, more simply and less expensively.

Figure 2A:
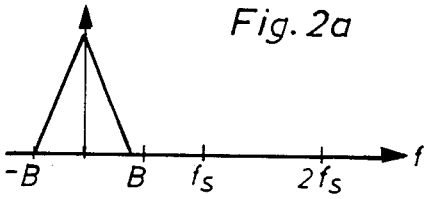
Figure 2B:
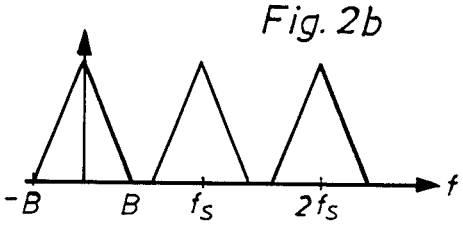

FIGS. 2*a* and 2*b* explain the theoretical basis of the invention. FIG. 2*a* illustrates a signal with the theoretical band width B, which is sampled at a sampling frequency $f_s$, periodical repetition of the signal frequency spectrum thus occurring according to FIG. 2*b*. Should the signal band width be equal to half the sampling frequency, the signal frequency spectra about each other and the amplitude values of adjacent bands will be reversed in relation to each other.

Figure 3A:
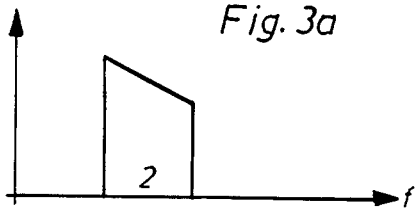
FIGS 3*a–d* are diagrams illustrating the different steps in the method, FIGS. 4*a*, *b* are diagrams explaining the reversal of the frequency band.
Figure 3B:
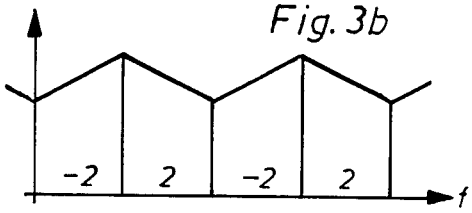
Figure 3C:
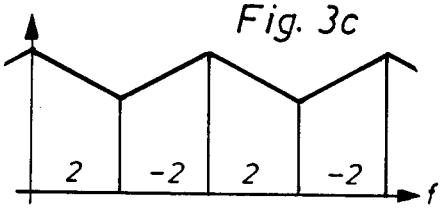
Figure 3D:
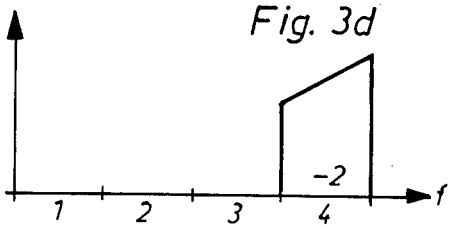

As an example, let it now be assumed that the frequency spectrum according to FIG. 1*a* has a bandwidth of 3000 Hz and is divided into four sub-bandwidths of 750 Hz each. To explain the inventive principle, let it be further assumed that sub-band 2 is to be moved to the position for sub-band 4, and furthermore reversed. The sub-band 2 is filtered out according to FIG. 3*a* and is sampled at a frequency of 1500 Hz. In this way there is obtained a periodic formation of sub-band 2 with a period of 1500 Hz, as will be seen from FIG. 3*b*, where the minus sign denotes reversal of the original sub-band. The spectrum in position 4 is to be reversed, and for this purpose the entire spectrum will be displaced 750 Hz according to FIG. 3*c*.

Figure 4A:
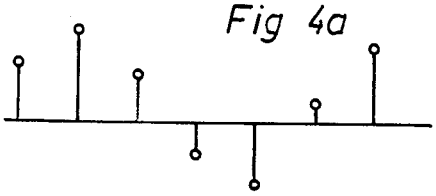
Figure 4B:
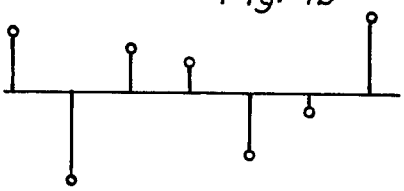

This is done by multiplying the time samples by $(-1)^n$, in accordance with chapter 3 of the already mentioned publication Digital Signal Processing, Uppenheim & Schafer, Prentice Hall. FIG. 4*a* illustrates a number of sampling values taken at a sampling frequency of 1500 Hz. To provide reversal, alternate samples are polarity reversed, as will be seen from FIG. 4*b*. By filtering out the fourth sub-band from this periodic spectrum, which has been shifted by 750 Hz, there has been obtained a reversal as well as displacement of the sub-band to position 4.

All sub-bands are dealt with in the same way, and then added to a common signal.

It should be noted that the necessity of frequency displacement varies from occasion to occasion. For example, if odd sub-bands are to be moved to even positions and reversed, no frequency displacement is required, since reversal is already obtained at the period formation.

Figure 5:
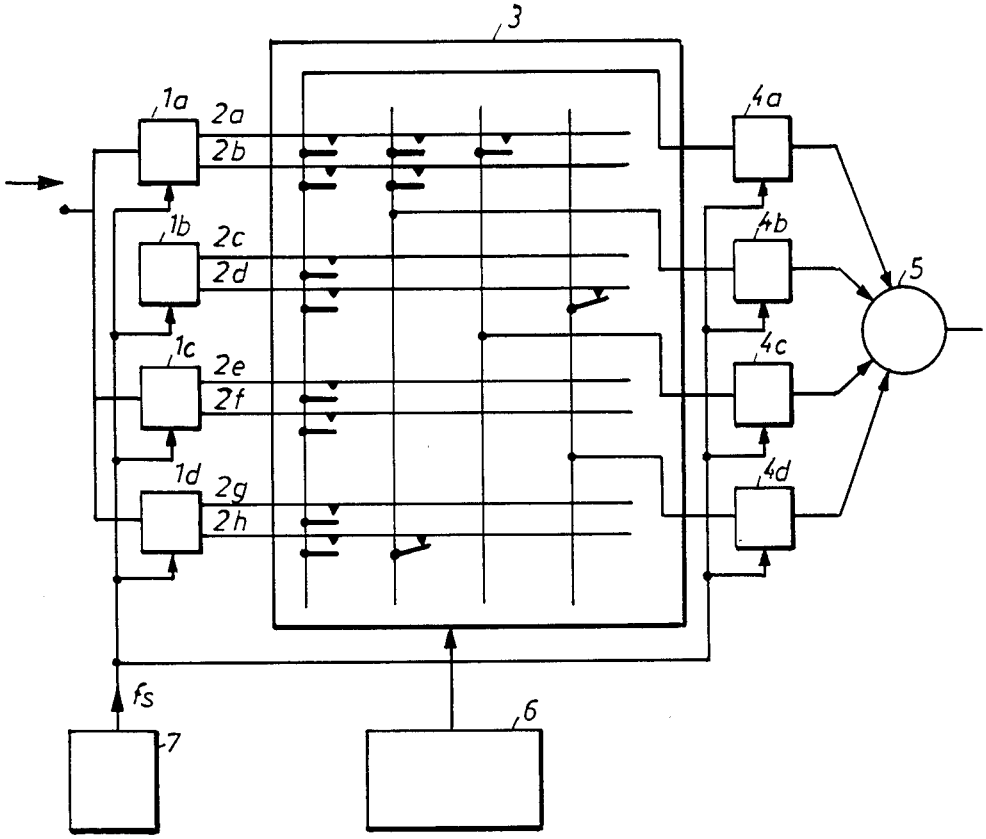
FIG. 5 illustrates an apparatus for carrying out the method in accordance with the invention.

FIG. 5 illustrates an apparatus for carrying out the method in accordance with the invention. The speech signals are fed to sampling filters 1a–1d, which are intended for the frequency bands 0–750, 750–1500, 1500–2250 and 2250–3000 Hz. The filters are sampled by a sampling means 7 at a frequency of 1500 Hz resulting in the above-mentioned periodic spectrum. The filters have a design such that they have two outputs, on one of which occur the sampled values and on the other the same sampled values but with alternatingly reversed polarity. All filter outputs 2a–2h are connected to a switching matrix 3, which can connect them to one of four bandpass filters 4a–4d, intended for the frequency bands 0–750, 750–1500, 1500–2250 and 2250–3000 Hz, respectively. Keeping in mind the previous example, where sub-band 2 was moved to position 4 and reversed, it will be seen here that the second output 2d of the filter 1b is connected to the filter 4d, which is associated with the fourth position in the spectrum. Since the output 2d of the filter 1b provides a periodic spectrum with its sub-bands reversed in relation to the sub-band obtained over the filter input, its periodic spectrum will have sub-bands which are reversed in relation to the original sub-band and occur at the frequencies 750–1500, 2250–3000, 3750–4500 Hz etc. The filter 4d will thus filter out the sub-band 2250–3000 Hz. The output signals from all four filters 4a–4d are fed to an adder (adding circuit) 5 to form a distorted form of the original signal. The contacts in the switching matrix 4 are indicated as relays contacts, but are actually electronic contacts which can be actuated by an electronic control means, e.g. a microprocessor 6. A way of further making unauthorized listening-in more difficult is to alter the code, according to which the sub-bands are moved and reversed, at uniform or variable time intervals, which can be done with the aid of the microprocessor 6.

Decoding the scrambled signal is performed analogously to the scrambling process. The difference is that in decoding, the received signal is connected to the input of the filters 1a–1d, the matrix contacts being set in correspondence with the recomposing key. Thus, for example, the output 2h of the filter 1d is connected to the input of filter 4b for reversing band 4 and moving it to position 2, and the output signals from the filters 4a–4d added to each other. The codes on the send and receive sides must of course be in agreement, and each alteration must take place simultaneously. It is thus obvious that the invention includes both coding and decoding.

As previously mentioned, a substantial advantage with the invention is that integrated techniques can be used, e.g. connected capacitance filters, so-called switch-C filters.

I claim:

1. A method of distorting a speech signal, having frequency bands, by at least one of the operations of rearranging and reversing frequency bands in said signal, said method comprising:

dividing the speech signal into a plurality of sub-bands by filtering;

individually sampling each of the sub-bands at a sampling frequency which is the same for each sub-band and which is at least double that of the bandwidth of the sub-bands for providing a plurality of first spectra of samples (FIG. 3*b*), each with periodic repetition of the respective sub-band;

reversing the polarity of alternate of said samples to provide a plurality of second spectra of samples (FIG. 3*c*), each with periodic repetition of the respective sub-band in a frequency reversed form;

filtering out from said first spectra or from said second spectra a sub-band corresponding to the original sub-band displaced with a desired number of sub-bands in dependence on a control signal; and adding all the obtained sub-bands for transmission of the distorted signal.

2. Speech signal processing apparatus for changing the character of speech signals within a given band of frequencies comprising:

a plurality of first filter means, each of said first filter means having a direct and a frequency reversing output, each of said first filter means selecting a sub-band of speech signals, each sub-band having substantially the same bandwidth, a sampling means for sampling the speech signal in each of said first filter means with the same signal having a frequency at least twice the frequency range of the sub-band bandwidth, to generate a plurality of first spectra of samples at said direct outputs and a second plurality of second and frequency reversed spectra at said frequency reversing outputs means of at least the polarity of at least some of said samples, a plurality of second filter means, each of said second filter means having a bandwidth associated with said sub-bands, switching means for controllably and selectively connecting the outputs of said first filter means to said second filter means, and adder means for combining the signals from said second filter means.

3. The apparatus of claim 2 wherein said filter means comprises coupled capacitance filters.

* * * * *